United States Patent [19]

Kageyama

[11] Patent Number: 4,618,280

[45] Date of Patent: Oct. 21, 1986

[54] PUSH-BUTTON WRITING INSTRUMENT WITH FRONT SEAL MEANS

[75] Inventor: Hidehei Kageyama, Kawagoe, Japan

[73] Assignees: Toyo Polymer Co., Ltd., Tokyo; Kotobuki & Co., Ltd., Kyoto, both of Japan

[21] Appl. No.: 640,693

[22] Filed: Aug. 14, 1984

[30] Foreign Application Priority Data

Feb. 1, 1984 [JP] Japan ..... 59-11628
Mar. 16, 1984 [JP] Japan ..... 59-37664

[51] Int. Cl.[4] ..... B43K 9/00
[52] U.S. Cl. ..... 401/107; 401/108
[58] Field of Search ..... 401/107, 108

[56] References Cited

U.S. PATENT DOCUMENTS 2,291,859 8/1942 Andrews ..... 401/107
3,525,573 8/1970 Fend ..... 401/108
3,637,316 1/1972 Bross ..... 401/107 X
3,945,734 3/1976 Woodbridge ..... 401/108 X
4,540,300 9/1985 Midorikawa ..... 401/108 X

FOREIGN PATENT DOCUMENTS 1284326 11/1968 Fed. Rep. of Germany ..... 401/107
1561814 4/1970 Fed. Rep. of Germany ..... 401/107

*Primary Examiner*—Steven A. Bratlie
*Attorney, Agent, or Firm*—Sherman and Shalloway

[57] ABSTRACT

A push-button type writing instrument is constructed of a refill received within a barrel slidably in the axial direction, a writing part receiving mechanism provided at a forward end portion of the refill, and sealing means provided with the writing part receiving mechanism for sealing a writing part. Owing to the provision of the sealing means, the ink of the writing instrument is kept free from evaporation and flow while the writing part is received within the barrel.

4 Claims, 5 Drawing Figures

PUSH-BUTTON WRITING INSTRUMENT WITH FRONT SEAL MEANS

BACKGROUND OF THE INVENTION

1. Field of the Invention

This invention relates to push-button type writing instruments making use of evaporative or volatile ink, such as felt pens, ball-point pens with water-base ink, etc.

2. Description of the Prior Art

A variety of push-button type structures has heretofore been proposed for writing instruments making use of evaporative or volatile ink, such as felt pens, ball-point pens with water-base ink, etc. Such conventional structures were all accompanied by such drawbacks so that their air tightness were poor and inks tended to evaporate off or they did not permit smooth core-projecting operations.

SUMMARY OF THE INVENTION

An object of this invention is to overcome the above-described drawbacks and to provide a push-button type writing instrument which has extremely good air tightness and can thus avoid evaporation of ink effectively, and permits smooth core-projecting operations.

Other objects and advantages of this invention will become more apparent from the following detailed description of the preferred embodiments, in which the accompanying drawings will be referred to.

PREFERRED EMBODIMENTS OF THIS INVENTION

Figure 1:
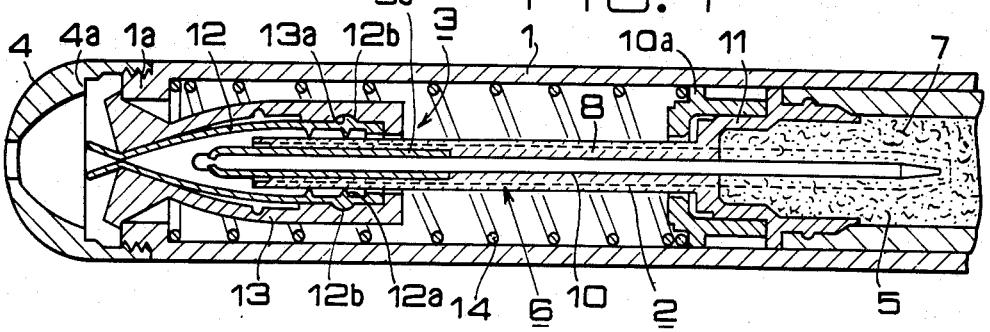
FIG. 1 is a longitudinal cross-sectional view of a push-button type writing instrument according to one embodiment of this invention.
Figure 2:
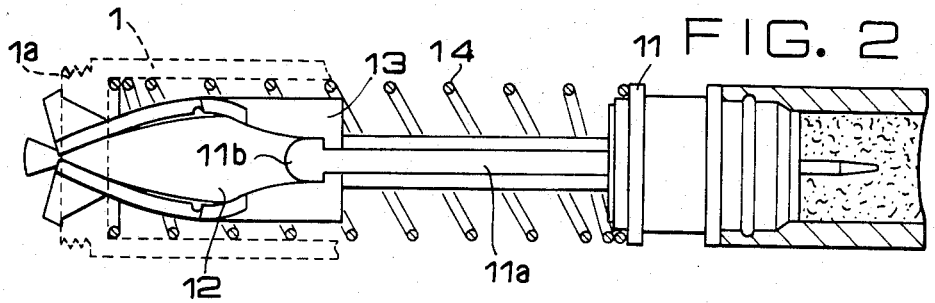
FIG. 2 is a fragmentary cross-sectional view of the writing instrument of FIG. 1.

Arranged within a barrel 1 are a refill 2, which is axially slidable and is replaceable by a fresh refill, and a writing part receiving mechanism 3 disposed at a forward end portion of the refill 2. The barrel 1 forwardly terminates in a conical tip 4 provided detachably thereon.

The refill 2 is equipped with an ink reservoir 7 and a writing part 6 provided in front of the ink reservoir 7. Within the ink reservoir 7, there is housed an absorbent 5 impregnated with an evaporative, volatile or water-base ink for ball-point pens or felt pens. Behind the ink reservoir 7, there is provided an advancing mechanism (not illustrated) adapted to advance and retract the refill 2 in its entirety, for example, a rotary cam set or the like. It should however be borne in mind that this advancing mechanism is not necessarily limited to such a rotary cam set but may be constructed into any structure so long as it can displace the refill 2 back and forth.

In the illustrated embodiment, the writing part 6 has an extension tube 8 provided in front of the ink reservoir 7 and a core member 9 extending through the extension tube 8 into the absorbent 5 at a rear end portion thereof. An air passageway 10 which is indispensable for the free flow of the ink is formed between the extension tube 8 and core member 9, whereby communicating the ink reservoir 7 with the atmosphere. Numeral 10*a* designates a guide sleeve.

In passing, it is worthy to note that the writing part 6 is not necessarily limited to the above-described structure. For example, the extension tube 8 may be formed either integrally or separately with the ink reservoir 7. It is also possible to omit the extension tube 8 and instead to press fit the core member 9, which has been covered by extending the guide sleeve 10*a* all over the core member 9, in the ink reservoir 7.

The writing part receiving mechanism 3 is detachably fit in its entirety over the refill 2 (more specifically, over the extension tube 8) as shown in FIG. 1. The writing part receiving mechanism 3 is slidably coupled with a cylindrical base 11 by way of a slide stem 11*a* and an interlocking portion 11*b* provided at the forward end of the slide stem 11*a*, and is equipped with a lead chuck 13 adapted to open and close a cylindrical seal (sealing means) 12, a chuck-closing ring 1*a* disposed around the lead chuck 13, and a coil spring 14 arranged under compression between the chuck-closing ring 1*a* and cylindrical base 11.

Here, the interlocking between the lead chuck 13 and slide stem 11*a* is achieved by merely hooking them each other. They will not be separated readily from each other under normal situation, since they are biased by the coil spring 14 in directions preventing their mutual interlocking from separation.

The cylindrical seal 12 is formed of an elastic material such as rubber or the like. As depicted in FIG. 1, it is provided on the inner wall thereof ridges 12*a* kept in contact with the extension tube 8 to seal up the spacing between the cylindrical seal 12 and extension tube 8 and on the outer wall thereof protrusions 12*b* press-fit in their corresponding recesses 13*a* of the lead chuck 13. Therefore, the cylindrical seal 12 will not separate from the lead chuck 13 even when the unillustrated rotary cam mechanism is operated and the slide stem 11*a* is caused to slide forwardly relative to the lead chuck 13 kept in abutment with an abutment shoulder 4*a* of the conical tip 4. Furthermore, the cylindrical seal 12 hermetically seals not only the writing part 6 but also the air passageway 10 which takes an important role for the free flow of the ink. Accordingly, the cylindrical seal 12 avoids not only evaporation of the ink but also flow of the ink while it is closed.

The operation of the above embodiment and its advantageous effects will next be described.

While the writing part 6 is received within the barrel 1 as depicted in FIG. 1, the writing part 6 is sealed by the cylindrical seal 12 as mentioned above. Thus, the evaporation and flow of the ink are prevented without failure.

Figure 3:
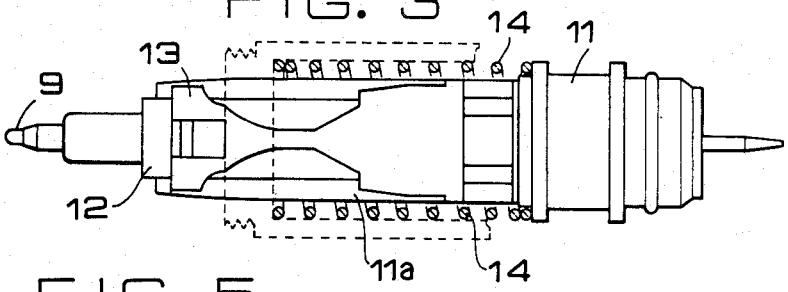
FIG. 3 is a plan view of the writing instrument, in which the core has already been projected out.

When the rear end of the ink reservoir 7 is pushed, the refill 2 is caused to advance in its entirety owing to the provision of the unillustrated advancing mechanism. Since the lead chuck 13 is kept in abutment against the dhuck-closing ring 1*a* of the barrel 1 and the forward displacement of the lead chuck 13 and cylindrical seal 12 is restrained by the abutment shoulder 4*a* of the conical tip 4, the core member 9 is caused to project through the conical tip 4 as shown in FIG. 3. Accordingly, the writing instrument is now ready for writing.

Since the cylindrical seal 12 is formed of the elastic material, it can form by its own elasticity an opening through which the core member 9 is allowed to project out. Even if the formation of the opening is not sufficient, the forward tip portion of the extension tube 8 pushes the inner wall of the cylindrical seal 12 outwardly. Therefore, there is not danger that the ink would stick on the cylindrical seal 12. The advancing and retracting operations of the writing part 6 may be performed readily and smoothly, because the slide stem 11*a* causes the lead chuck 13 to slide and both slide stem 11*a* and lead chuck 13 undergo displacement in a superposed fashion.

Figure 5:
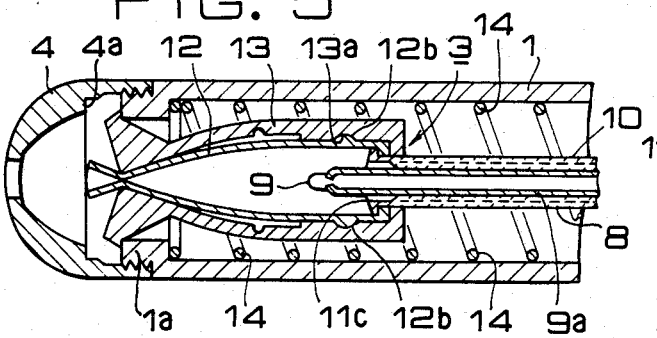
FIG. 5 is a fragmentary, longitudinal, cross-sectional view of a push-button type writing instrument according to another embodiment of this invention.
Figure 4:
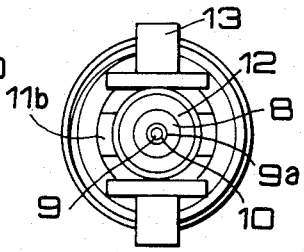
FIG. 4 is a front view of the writing instrument of FIG. 3.

FIG. 5 illustrates another embodiment of this invention, in which the slide stem 11*a* has been omitted.

In this embodiment, the cylindrical seal 12 is, similar to the former embodiment, press-fit at the protrusions in the recesses 13*a* of the lead chuck 13. However, the cylindrical seal 12 is hermetically kept in contact with an interlocking end portion 11*c* formed at the forward extremity of the extension tube 8, which extends forwardly from the cylindrical base 11 (see, FIGS. 1–4), and the circumferential wall of the extension tube 8.

Accordingly, while the writing part 6 is received in the barrel 1 as shown in FIG. 5, the cylindrical seal 12 is kept air-tight by the interlocking end portion 11*c* of the cylindrical base 11. Therefore, the ink is prevented from evaporation and flow without failure.

When the rear end of the ink reservoir 7 (see, FIGS. 1–4) is pushed, the refill 2 is caused in its entirety to advance and the extension tube 8 of the cylindrical base 11 slides through the lead chuck 13 and cylindrical seal 12 in the same manner as in the former embodiment. Thus, the core member 9 is caused to project out through the conical tip 4, thereby making the writing instrument ready for use. This embodiment does not require such a slide stem as employed in the former embodiment, thereby making its structure still simpler.

As has been described above, the present invention can bring about such excellent effects that while the core member is received within the barrel, the core member is completely sealed by the cylindrical seal to avoid the evaporation of the ink effectively, and when it is necessary to project the core member out of the barrel, the extension tube is caused to slide and the core member is hence allowed to project out smoothly.

What is claimed is:

1. A push-button type writing instrument having a barrel and comprising:

(a) a refill received within said barrel and slidable in an axial direction thereof, (b) a writing part receiving mechanism provided at a forward end portion of the refill, said writing part receiving mechanism being slidably coupled with a cylindrical base by way of a slide stem and an interlocking portion provided at a forward end of the slide stem and said writing part receiving mechanism being further equipped with a lead chuck adapted to open and enclose a cylindrical seal, a chuck closing ring loose-fit on said lead chuck and a coil spring disposed under compression between said chuck closing ring and said cylindrical base, (c) sealing means provided with the writing part receiving mechanism at said forward end portion of the refill for sealing said writing part, and said sealing means being formed of an elastic cylindrical seal and a lead chuck fit over the cylindrical seal, and (d) said barrel being equipped adjacent to its forward end with an annular inwardly extending protrusion adapted to close the lead chuck.

2. A push-button type writing instrument as claimed in claim 1, wherein the cylindrical seal is opened by its own elasticity for allowing the writing part to project out of the barrel.

3. A push-button type writing instrument as claimed in claim 1, wherein the refill extends slidably through the sealing means and the cylindrical seal is opened by a forward end portion of the refill for allowing the writing part to project out of the barrel.

4. A push-button type writing instrument as claimed in claim 3, wherein the refill and sealing means are normally biased in opposite directions so as to establish an air-tight contact therebetween.

* * * * *